US005086799A

United States Patent [19]

Lumbleau

[11] Patent Number: 5,086,799

[45] Date of Patent: Feb. 11, 1992

[54] VEHICLE COVER

[76] Inventor: John J. Lumbleau, 14208 Hughes La., Dallas, Tex. 75240

[21] Appl. No.: 549,809

[22] Filed: Jul. 9, 1990

[51] Int. Cl.[5] ..... E04H 15/04

[52] U.S. Cl. ..... 135/90; 296/136

[58] Field of Search ..... 135/90; 52/83, 125.6; 296/136

[56] References Cited

U.S. PATENT DOCUMENTS

| | | | |
|---|---|---|---|
| 447,842 | 3/1891 | Partridge | 135/90 |
| 844,220 | 2/1907 | Westbrooke . | |
| 969,899 | 9/1910 | Partington | 135/90 |
| 1,285,766 | 11/1918 | Martin . | |
| 1,759,628 | 1/1928 | Pellegrino . | |
| 1,801,247 | 6/1928 | Rush . | |
| 1,849,738 | 3/1932 | Amico . | |
| 4,019,212 | 4/1977 | Downer | 9/1.5 |
| 4,363,284 | 12/1982 | Monroe | 114/361 |
| 4,817,654 | 4/1989 | Christensen | 135/90 |

*Primary Examiner*—Henry E. Raduazo

*Attorney, Agent, or Firm*—Ross, Howison, Clapp & Korn

[57] ABSTRACT

A cover and apparatus for raising and lowering the cover suspended from an overhead structure for selectively covering a vehicle parked thereunder where the cover includes a front, back and sides and the apparatus for raising and lowering the cover includes a bar having first and second ends and extending between the sides of the cover and integrally connected to the cover. First and second pulleys are attached to the overhead structure and are generally disposed above the bar first and second ends, respectively. A first cable having first and second ends and extending through the first and second pulleys is further provided. The first end of the first cable is connected to the first end of the bar and the second end of the first cable is connected to the second end of the bar. A second cable having first and second ends is provided such that the first end thereof is connected to the first cable between the first and second pulleys, such that by pulling on or releasing the second end of the second cable, the bar raises and lowers the cover, respectively with respect to the vehicle.

17 Claims, 4 Drawing Sheets

VEHICLE COVER

TECHNICAL FIELD OF THE INVENTION

This invention relates to vehicle covers, and more particularly to a suspended cover which is easily lowered over a vehicle and raised to a storage position when not in use.

BACKGROUND OF THE INVENTION

Installing and removing covers for vehicles such as for example a boat, is both time consuming and difficult. Depending upon the size of the boat, one or more individuals are required to install and remove the cover, which operation must be coordinated among the individuals. Where smaller covers are utilized, certain areas of a boat may be unprotected from the elements.

A need has thus arisen for a complete vehicle cover that is durable, easy to install and remove while simultaneously providing maximum protection against the elements for the entire vehicle when covered.

SUMMARY OF THE INVENTION

In accordance with the present invention, a cover and apparatus for raising and lowering the cover suspended from an overhead structure for selectively covering a vehicle parked thereunder is provided. The cover includes front, back and sides. The apparatus for raising and lowering the cover includes a bar having first and second ends and extending between the sides of the cover and integrally connected to the cover. First and second pulleys are attached to the overhead structure and are generally disposed above the bar first and second ends, respectively. A first cable having first and second ends and extending through the first and second pulleys is further provided. The first end of the first cable is connected to the first end of the bar and the second end of the first cable is connected to the second end of the bar. A second cable having first and second ends is provided such that the first end thereof is connected to the first cable between the first and second pulleys, such that by pulling on or releasing the second end of the second cable, the bar raises and lowers the cover, respectively with respect to the vehicle.

In accordance with another aspect of the present invention, a cover and apparatus for raising and lowering the cover suspended from an overhead structure for selectively covering a vehicle parked thereunder is provided. The cover includes front, back and sides. The apparatus for raising and lowering the cover includes a first bar having first and second ends and extending between the sides of the cover and integrally connected to the cover. First and second pulleys are attached to the overhead structure and are generally disposed above the first bar first and second ends, respectively. A first cable having first and second ends is provided. The first end of the first cable is connected to the first bar first end and passes through the first pulley. A second cable having first and second ends is provided. The first end of the second cable is connected to the first bar second end and passes through the second pulley. A second bar having first and second ends extends between the sides of the cover and is spaced apart from the first bar and is integrally attached to the cover. Third and fourth pulleys are attached to the overhead structure and are generally disposed above the second bar first and second ends, respectively. A third cable having first and second ends is provided. The first end of the third cable is connected to the second bar first end and passes through the third pulley. A fourth cable having first and second ends is provided. The first end of the fourth cable is connected to the second bar second end and passes through the fourth pulley. The second ends of the first and second cables and the second ends of the third and fourth cables are manipulated by pulling on or releasing for raising and lowering the first and second bars, respectively with respect to the vehicle in the areas of the first and second bars.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
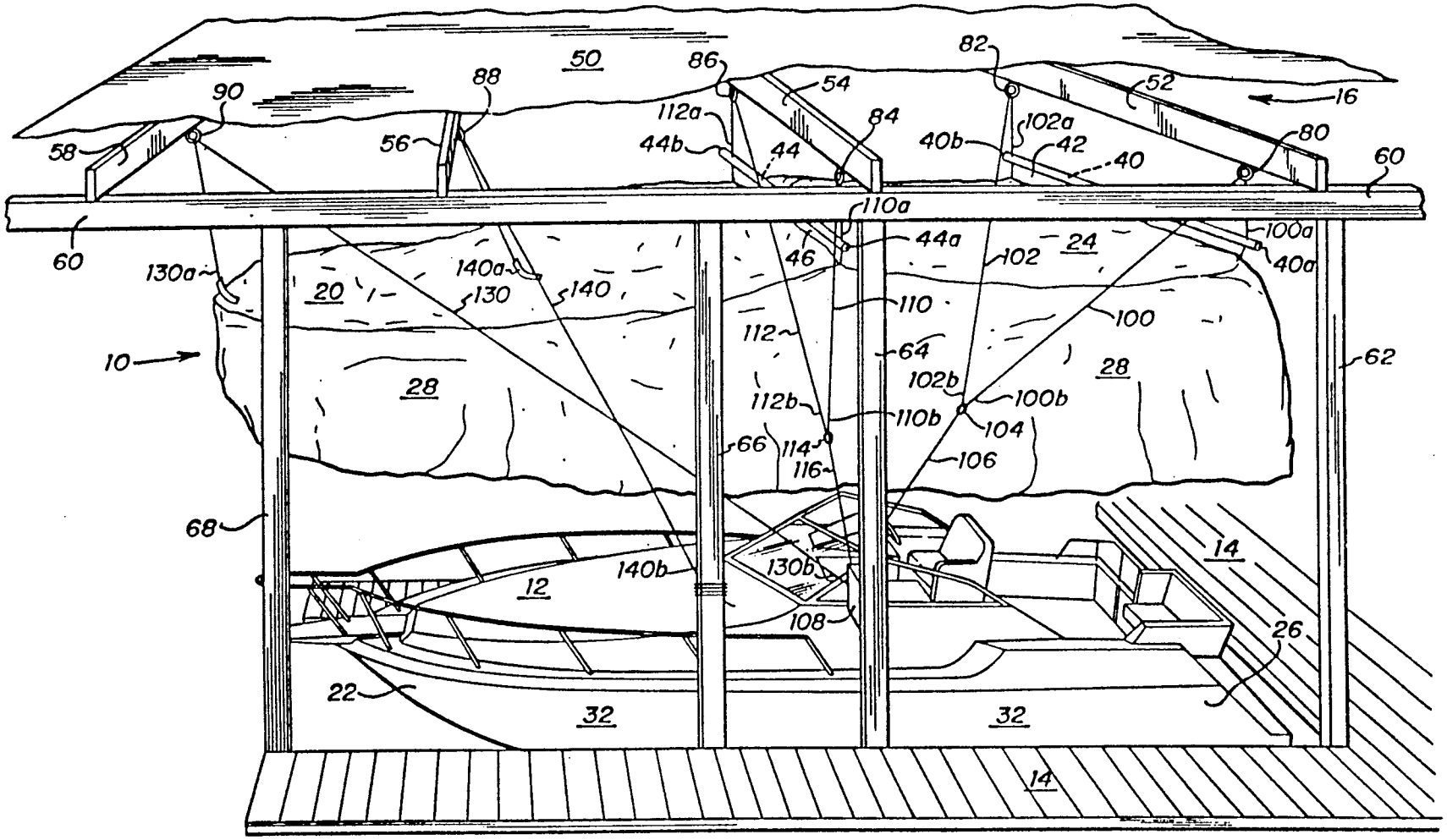
FIG. 1 is a perspective view of a boat utilizing the present shown in the raised position.

Referring simultaneously to FIGS. 1, 2, 3 and 4, the vehicle cover of the present invention is illustrated, and is generally identified by the numeral 10. Cover 10 is illustrated in the Figures for use as a cover for a boat 12 parked at a dock 14 having an overhead structure, generally identified by the numeral 16. However, the present invention is not limited to the use with a boat, it being understood that the present invention may be utilized for covering any type of vehicle, such as for example, an automobile parked within a garage or under a carport or other overhead structure.

Cover 10 may be comprised of, for example, fabric, plastic such as polyvinylchloride or the like and is chosen in such size to accommodate the vehicle to be covered. Cover 10 includes a front portion 20 disposed adjacent to bow 22 of boat 12, a rear portion 24 disposed adjacent to stern 26 of boat 12 and side portions 28 and 30 disposed adjacent to sides 32 and 34 of boat 12, respectively.

Cover 10 includes a rod 40 having ends **40*a* and 40*b*. Rod 40 is integrally attached to cover 10 adjacent to rear portion 24 such as for example, by passing through a loop 42 within cover 10. Cover 10 further includes a rod 44 having ends 44*a* and 44*b* which is spaced apart from rod 40 and is also integrally connected to cover 10 through, such as for example, a loop 46 fabricated within cover 10. Rod 44 is disposed centrally with respect to stern 26 and bow 22 of the boat 12**.

Overhead structure 16 includes a roof 50 and roof beams 52, 54, 56, and 58. Roof beams 52, 54, 56 and 58 are supported by a beam 60 and posts 62, 64, 66, and 68.

Roof beam 52 supports pulleys 80 and 82. Roof beam 54 supports pulleys 84 and 86. Roof beam 56 supports a pulley 88. Roof beam 58 supports a pulley 90.

Figure 2:
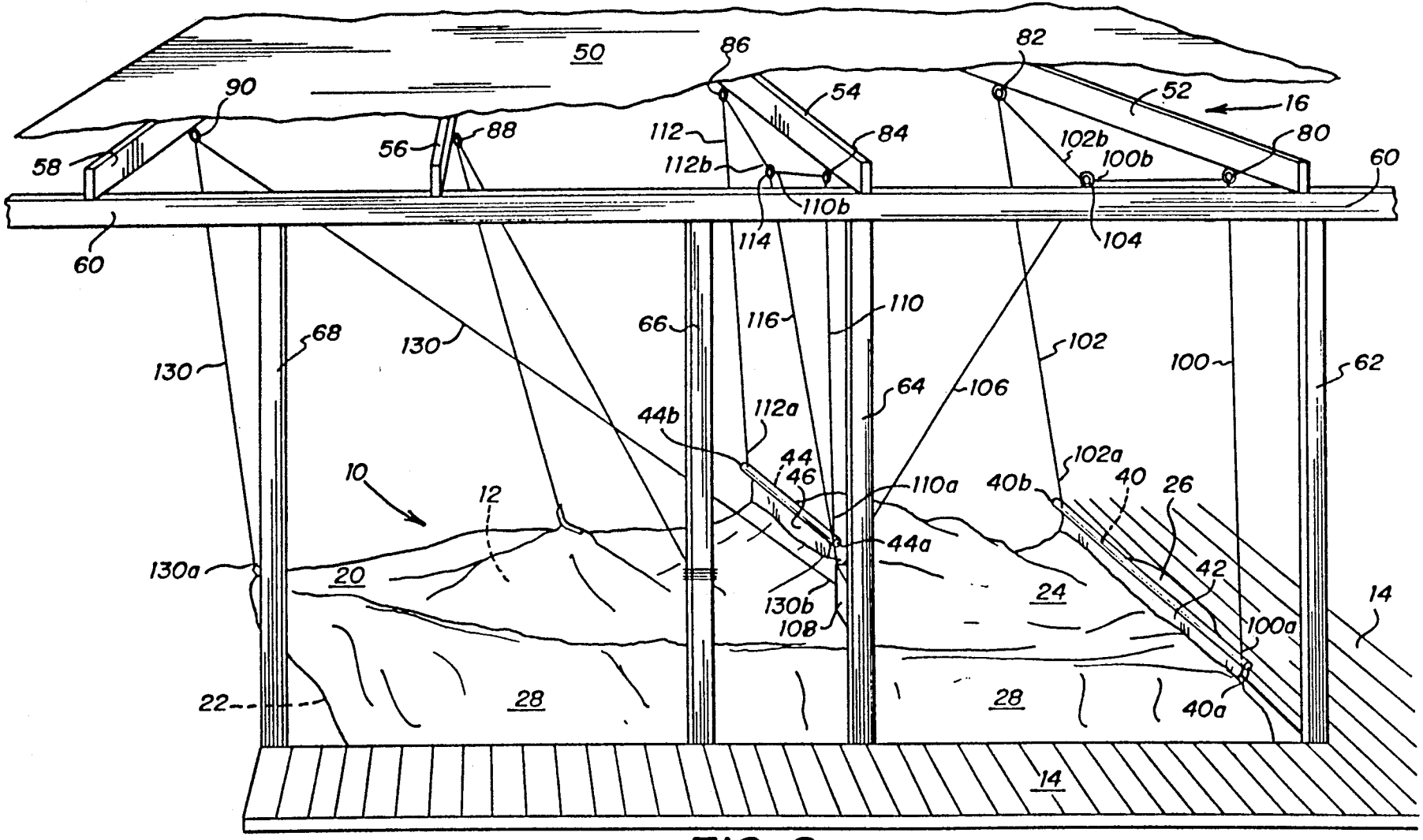
FIG. 2 is a perspective view of the boat of FIG. 1 illustrating the present cover in the installed and covered position.
Figure 3:
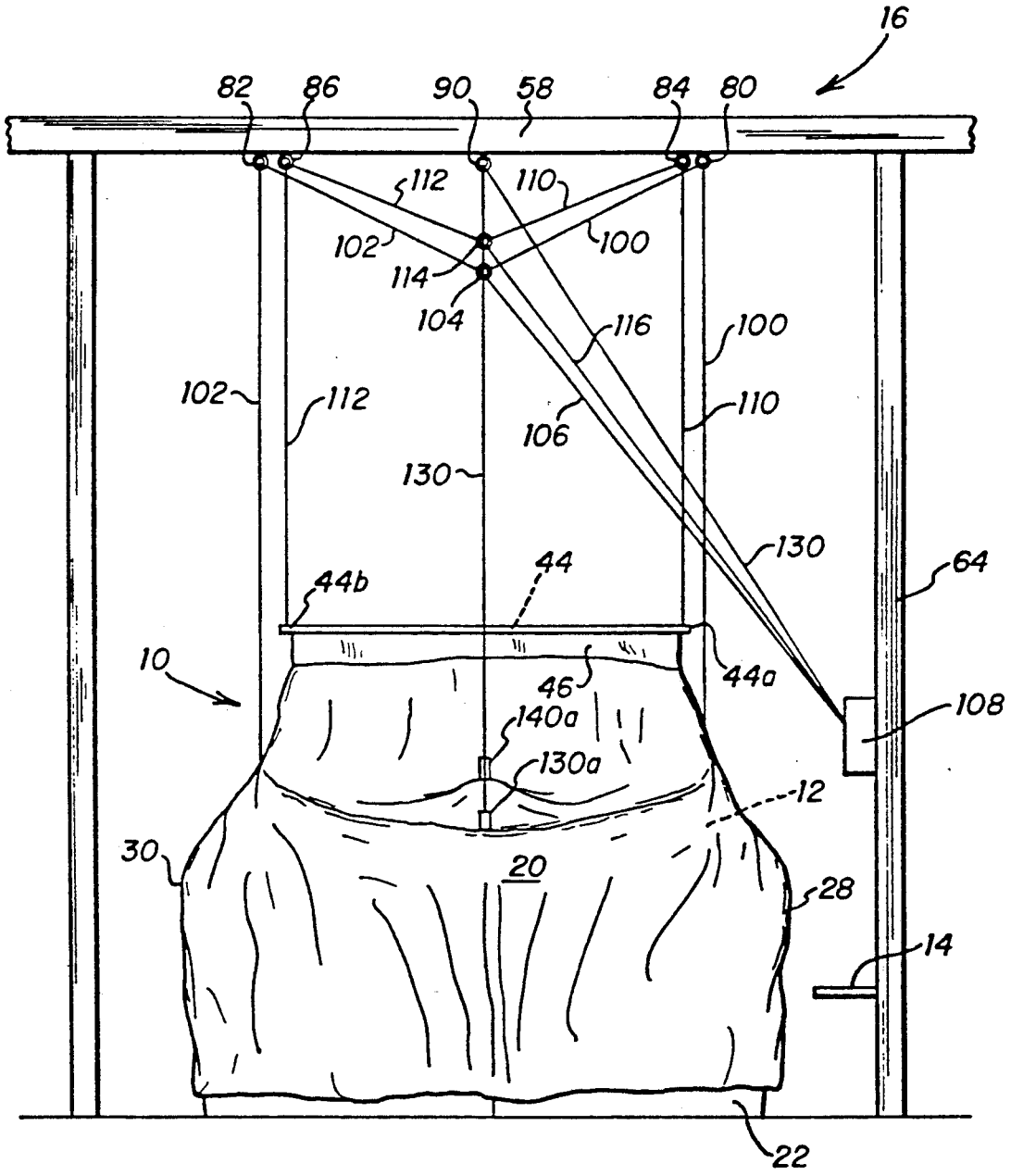
FIG. 3 is a front elevated view of the boat shown in FIG. 2.
Figure 4:
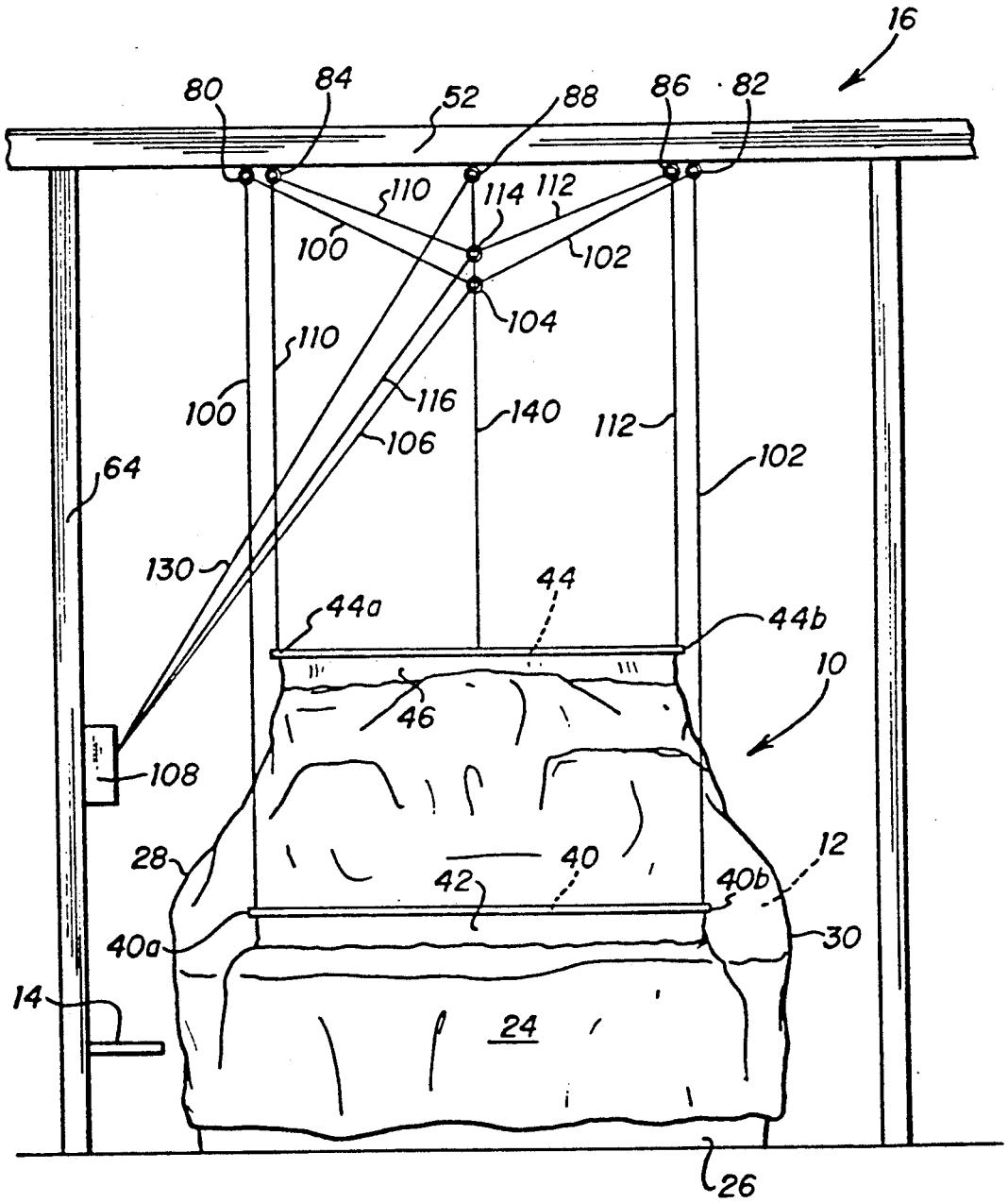
FIG. 4 is a rear elevational view of the boat shown in FIG. 2.

The present apparatus for raising and lowering cover 10 from the position illustrated in FIG. 1 to the position illustrated in FIGS. 2, 3 and 4, includes a first cable 100 having ends **100*a* and 100*b*. Cable 100** passes through pulley 80 such that end 100*a* is interconnected to end 40*a* of rod 40. A second cable 102 having ends 102*a* and 102*b* passes through pulley 82, such that end 102*a* is interconnected to end 40*b* of rod 40. Ends 100*b* and 102*b* of cables 100 and 102, respectively, are interconnected to a ring 104. A third cable 106 is interconnected to ring 104 and to a winch 108 mounted to post 64. Actuation of winch 108 decreases the length of third cable 106 such that cables 100 and 102 are pulled toward post 64 thereby raising the rear portion 24 of cover 10 from the covered position as illustrated in FIG. 2 to the suspended position as illustrated in FIG. 1.

A cable system similar to cables 100, 102 and 106 is connected to rod 44 for raising and lowering the cover 10 in the area of rod 44. Cable 110 having ends 110*a* and 110*b* passes through pulley 84, such that end 110*a* is interconnected to end 44*a* of rod 44. A cable 112 having ends 112*a* and 112*b* passes through pulley 86, such that end 112*a* is interconnected to end 44*b* of rod 44. Ends 110*b* and 112*b* of cables 110 and 112 are interconnected to a ring 114. Ring 114 is interconnected to a cable 116 which is also connected to winch 108. Actuation of winch 108 raises and lowers cover 10 in the area of rod 44.

Front portion 20 of cover 10 is raised and lowered through the operation of a cable 130 having ends 130*a* and 130*b*. Cable 130 passes through pulley 90 such that end 130*b*. Cable 130 passes through pulley 90 such that end 130*a* is connected to front portion 20 of cover 10 and end 130*b* is interconnected to winch 108. Actuation of winch 108 raises and lowers front portion 20 of cover 10.

It therefore can be seen that through operation of winch 108, cables 106, 116, and 130 simultaneously raise and lower cover 10 throughout the length of cover 10 from front portion 20 to rear portion 24, thereby installing or removing cover 10 from boat 12. Although the actuating mechanism for raising and lowering cover 10 through cables 106, 116, and 130 has been shown as winch 108, cables 106, 116 and 130 can be manually pulled and released for raising and lowering cover 10 with respect to boat 12.

Although cables 100 and 102; and cables 110 and 112 have been described as two separate cables interconnected to rings 104 and 114, respectively, a single cable can be utilized interconnected to ends 40*a* and 40*b* of rod 40 and a single cable can be utilized interconnected between ends 44*a* and 44*b* of rod 44 passing through a ring. Use of rings 104 and 114 allow for the adjustment in the lengths of the cable to ensure that the ends of each of the rods 40 and 44 are lifted and lowered simultaneously such that sides 28 and 30 of cover 10 raise and lower at the same rate.

An additional cable 140 having ends 140*a* and 140*b* passes through pulley 88. End 140*a* is interconnected to cover 10 intermediate front portion 20 and the area to which rod 44 is attached. End 140*b* is interconnected to post 66. Cable 140 as more clearly illustrated in FIG. 3 is utilized to form a raised portion of cover 10 while cover 10 is in the installed position to apply tension on the bow area of cover 10 to provide a "tent" area to prevent any water puddling on cover 10 that might occur from rain falling on boat 12. Cable 140 is not generally utilized to raise and lower cover 10.

If it is desired to only cover or uncover a portion of boat 12, each cable 106,116 or 130 can be independently actuated through winch 108 or manually operated such that only a portion of boat 12 in the area of stern 26, bow 22 or the central portion of boat 12 can be covered or uncovered.

Although two rods 40 and 44 have been illustrated for use with cover 10, it is understood that additional rods may be utilized for larger vehicles or a single rod can be utilized for a small vehicle to be covered utilizing cover 10 in accordance with the present invention.

It therefore can be seen that the present cover and apparatus for raising and lowering the present cover is easy to put in place, remove and store while simultaneously providing maximum protection and coverage for the vehicle being covered. The present cover can be raised and lowered automatically or manually by a single person.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A cover and apparatus for raising and lowering the cover suspended from an overhead structure for selectively covering a vehicle parked thereunder, comprising:

a cover having a front, a back and sides;

a first bar having first and second ends and extending between said sides of said cover and integrally connected to said cover;

first and second pulleys attached to the overhead structure and generally disposed above said first bar first and second ends, respectively;

a first cable having first and second ends, and extending through said first and second pulleys, said first end thereof connected to said first end of said bar and said second end thereof connected to said second end of said bar;

a second cable having first and second ends, said first end thereof connected to said first cable between said first and second ends, such that by pulling on or releasing said second end of said second cable, said bar raises and lowers said cover, respectively with respect to the vehicle in the area of said first bar;

a second bar having first and second ends extending between said sides of said cover and spaced apart from said first bar, and integrally connected to said cover;

third and fourth pulleys attached to the overhead structure and generally disposed above said second bar first and second ends, respectively;

a third cable having first and second ends, said first end thereof connected to said second bar first end and for passing through said third pulley;

a fourth cable having first and second ends, said first end thereof connected to said second bar second end and for passing through said fourth pulley; and such that by pulling on or releasing said second ends of said third and fourth cables, said second bar raises or lowers said cover, respectively with respect to the vehicle in the area of said second bar.

2. The apparatus of claim 1 and further including:

a fifth cable having first and second ends, said first end thereof attached to said cover spaced apart from said first bar; and a fifth pulley attached to the overhead structure for receiving said fifth cable, such that by pulling on or releasing said second end of said fifth cable, said cover raises and lowers with respect to the vehicle in the area of attachment between said fifth cable first end and said cover.

3. The apparatus of claim 2 wherein said first bar is attached to said cover back and said fifth cable first end is attached adjacent to said cover front.

4. The apparatus of claim 1 wherein said first bar is attached to said cover between said front and back of said cover.

5. A cover and apparatus for raising and lowering the cover suspended from an overhead structure for selectively covering a vehicle parked thereunder, comprising:

a cover having a front, a back and sides;

a first bar having first and second ends and extending between said sides of said cover and integrally connected to said cover;

first and second pulleys attached to the overhead structure and generally disposed above said first bar first and second ends, respectively;

a first cable having first and second ends, said first end thereof connected to said first bar first end and for passing through said first pulley;

a second cable having first and second ends, said first end thereof connected to said first bar second end and for passing through said second pulley;

such that by pulling on or releasing said second ends of said first and second cables, said first bar raises or lowers said cover, respectively, with respect to the vehicle in the area of said first bar;

a second bar having first and second ends extending between said sides of said cover and spaced apart from said first bar, and integrally connected to said cover;

third and fourth pulleys attached to the overhead structure and generally disposed above said second bar first and second ends, respectively;

a third cable having first and second ends, said first end thereof connected to said second bar first end and for passing through said third pulley;

a fourth cable having first and second ends, said first end thereof connected to said second bar second end and for passing through said fourth pulley; and such that by pulling on or releasing said second ends of said third and fourth cables, said second bar raises or lowers said cover, respectively with respect to the vehicle in the area of said second bar.

6. The apparatus of claim 5 and further including:

a fifth cable having first and second ends, said first end thereof attached to said cover spaced apart from said first bar; and a fifth pulley attached to the overhead structure for receiving said fifth cable, such that by pulling on or releasing said second end of said fifth cable, said cover raises and lowers with respect to the vehicle in the area of attachment between said fifth cable first end and said cover.

7. The apparatus of claim 6 wherein said first bar is attached adjacent to said cover back and said fifth cable first end is attached adjacent to said cover front.

8. The apparatus of claim 6 wherein said first bar is attached to said cover adjacent said cover back, said second bar is attached to said cover between said cover back and cover front, and said fifth cable first end is attached to said cover front.

9. The apparatus of claim 6 and further including:

means for simultaneously pulling on or releasing said second ends of said first, second, third, fourth, and fifth cables.

10. The apparatus of claim 5 wherein said first bar is attached to said cover between said front and back of said cover.

11. The apparatus of claim 5 wherein said first bar is attached to said cover adjacent said cover back and said second bar is attached to said cover between said cover front and back.

12. The apparatus of claim 5 and further including:

means for simultaneously pulling on or releasing said second ends of said first, second, third, and fourth cables.

13. The apparatus of claim 5 wherein said means for pulling on or releasing said second ends of said cables includes a winch.

14. The apparatus of claim 5 and further including:

connecting means for interconnecting said second ends of said first and second cables to a fifth cable having first and second ends, said first end of said fifth cable connected to said connecting means, such that by pulling on or releasing said second end of said fifth cable, said first bar raises or lowers said cover, respectively with respect to the vehicle.

15. The apparatus of claim 5 and further including:

first connecting means for interconnecting said second ends of said first and second cables to a fifth cable having first and second ends, said first end of said fifth cable connected to said first connecting means, such that by pulling on or releasing said second end of said fifth cable, said first bar raises or lowers said cover, respectively, with respect to the vehicle in the area of said first bar; and second connecting means for interconnecting said second ends of said third and fourth cables to a sixth cable having first and second ends, said first end of said sixth cable connected to said second connecting means, such that by pulling on or releasing said second end of said sixth cable, said second bar raises or lowers said cover, respectively, with respect to the vehicle in the area of said second bar.

16. The apparatus of claim 15 including:

means for simultaneously pulling on or releasing said second ends of said fifth and sixth cables.

17. The apparatus of claim 16 wherein said means for simultaneously pulling on or releasing said second ends of said fifth and sixth cables includes a winch.

* * * * *